United States Patent [19]

Bemis et al.

[11] 4,212,552

[45] Jul. 15, 1980

[54] IMPACT PRINTER CARDHOLDER WITH INTEGRAL RIBBON GUIDE AND END OF RIBBON SENSOR

[75] Inventors: John D. Bemis, Charlotte, N.C.; Willie Goff, Jr., Austin, Tex.

[73] Assignee: International Business Machines Corporation, Armonk, N.Y.

[21] Appl. No.: 958,276

[22] Filed: Nov. 6, 1978

[51] Int. Cl.[2] ..... B41J 35/36

[52] U.S. Cl. ..... 400/249; 400/144.2; 400/521

[58] Field of Search ..... 400/521, 543, 542, 535, 400/248, 249, 536, 537, 538

[56] References Cited

U.S. PATENT DOCUMENTS

| | | | |
|---|---|---|---|
| 1,174,555 | 3/1916 | Fowler | 400/543 X |
| 1,679,845 | 8/1928 | Waldheim | 400/248 X |
| 2,044,072 | 6/1936 | Going | 400/248 X |
| 2,331,331 | 10/1943 | Lambert | 400/248 X |
| 2,345,557 | 4/1944 | Elliott | 400/535 X |
| 2,687,200 | 8/1954 | Ford | 400/248 X |
| 2,695,091 | 11/1954 | Ford et al. | 400/248 |
| 2,821,284 | 1/1958 | Garwood et al. | 400/249 X |
| 3,404,628 | 10/1968 | Lee | 101/291 |

OTHER PUBLICATIONS

Paulson, "Illuminated Card Guide," IBM Technical Disclosure Bulletin, vol. 18, No. 9, Feb. 1976, p. 2943.

Craft, "Paper Insertion Realignment Mechanism," IBM Technical Disclosure Bulletin, vol. 11, No. 4, Sep. 1968, p. 390.

Coots et al., "Print Shield," IBM Tech. Disc. Bul., vol. 18, No. 9, Feb. 1976, pp. 2954–2955.

Habick et al., "Typing Shield," IBM Tech. Disc. Bul., vol. 9, No. 6, Nov. 1966, p. 688.

Isaacs, "Aligned Underscore Guide," IBM Tech. Disc. Bul., vol. 11, No. 11, Apr. 1969, p. 1489.

*Primary Examiner*—Clifford D. Crowder

*Attorney, Agent, or Firm*—J. B. Kraft

[57] ABSTRACT

In an impact printer with a conventional combination of platen and cardholder wherein the cardholder has an inner surface with a curvature matching that of the platen and is mounted adjacent to but spaced from the platen so that a sheet of printing medium may be moved between the cardholder and platen and wherein conventional impact printing is carried out by impact means acting upon the sheet through an opening in the cardholder, an improved cardholder structure is provided wherein the cardholder comprises integral ribbon guide means for guiding the printer ribbon in a path along the outer surface of the cardholder across the opening whereby the impact means may selectively drive the ribbon through the opening to print upon the sheet.

In accordance with another aspect of the present invention, the cardholder further comprises integral end of ribbon sensing means mounted in a fixed position along said ribbon path.

3 Claims, 2 Drawing Figures

IMPACT PRINTER CARDHOLDER WITH INTEGRAL RIBBON GUIDE AND END OF RIBBON SENSOR

DESCRIPTION

BACKGROUND OF THE INVENTION

1. Field of the Invention

This invention relates to impact printers. More specifically, it relates to the cardholder mechanism in such impact printers.

2. Description of the Prior Art

Impact printers have traditionally used cardholders or sheet holders to maintain sheet of printing media flush against the platen of the printer. Conventionally, such cardholders have an inner surface with a curvature essentially corresponding to the curvature of the platen and are mounted adjacent to but spaced from the platen so that a sheet of printing medium may be inserted between the cardholder and the platen. The cardholder, of course, has an opening therethrough so that the impact means may be selectively activated through the opening to print upon the sheet. Conventionally such impact printing is carried out by moving the printer ribbon along a path between the cardholder and the printer disk or daisy wheel containing the characters to be printed on a plurality of radial petals. When a selected character is to be printed, the wheel is rotated into the particular print position after which impact means such as the hammer or missile drive the selected petal against the ribbon to drive the ribbon through the opening in the cardholder to impact the selected character upon the sheet of paper or other printing medium.

In an attempt to meet the ever-increasing demand in the printer field for higher and higher printing speed in excess of 50 characters per second and approaching 100 characters per second, designers of impact printers have been attempting to minimize the flight path of the selected character petal, i.e., the distance that the petal must travel in driving the ribbon against the sheet. In this connection, distances in the order of 1/10th of an inch between the face of the printer wheel petal and the platen would not be unreasonable in high speed printers. Since the ribbon, the cardholder and the paper all must fit and be translationally movable within this limited space, problems of maintaining very close tolerances between these elements are presented. Such problems involve maintaining the necessary spatial relationship between the sheet, the cardholder and the ribbon in initially setting up the printer as well as when it becomes necessary to move the cardholder for cleaning or other maintenance problems when the equipment is on-line. When the cardholder is periodically adjusted, it must be mounted in such a position that its distance from the platen is sufficient to accommodate the sheet of printing media. Similarly, the ribbon must be adjusted with respect to the cardholder in the appropriate spatial relationship so that friction smearing between the two members is minimized. Similarly, translational adjustments of the cardholder in the X and Y direction may require adjustments of the ribbon path in these directions with similar close tolerances as well as corresponding adjustments for a particular end of ribbon sensing means associated with the ribbon.

At best, in conventional printer equipment, the correlation of adjustment of the cardholder, ribbon guide means and end of ribbon sensing means are tedious, time consuming, and require considerable skill.

BRIEF DESCRIPTION OF PRESENT INVENTION

As will be seen hereinafter, the present invention solves the above described tolerance problem between ribbons and cardholders.

In this respect, it is the primary object of the present invention to provide means for quickly and easily adjusting ribbon positions in correlation with changes in cardholder positions.

It is another object of the present invention to provide means for adjusting the position of end of ribbon sensing means in correlation to adjustments in the position of ribbons and cardholders.

It is a further object of the present invention to provide means for adjusting the positions of ribbons in correlation with positional changes in cardholders in high speed printers having very close tolerances in cardholder and ribbon positions.

It is an even further object of the present invention to provide an expedient for moving the cardholder temporarily out of its operational position for cleaning purposes and then moving the cardholder back into operational positions without any need for adjustments in the positions of the ribbon guide means and end of ribbon sensing means.

The present invention accomplishes the above objects by a modification of the previously described impact printer cardholder so that the cardholder comprises integral ribbon guide means for guiding the ribbon in a path along the surface of the cardholder which is opposite to the surface which holds the sheet of printing medium. The ribbon guide means in the cardholder will guide the ribbon across the opening therein through which the ribbon may be driven against the sheet during the impact printing step.

With the present cardholder structure, when it is necessary to move the cardholder in and out with respect to the platen or the print wheel or when the cardholder is adjusted translationally in the X and Y direction, the ribbon guide means which form an integral part of the cardholder are of course, correspondingly moved and adjusted. Thus, the ribbon guide means will retain their fixed positional relationship to the cardholder irrespective of how the cardholder is moved or adjusted.

In accordance with a more specific aspect of the present invention, the cardholder further includes integral end of ribbon sensing means. Thus, in a similar fashion, when the cardholder is moved or adjusted in the above described directions, the end of ribbon sensing means will be correspondingly adjusted. No independent adjustment of either the ribbon guide means or the end of ribbon sensing means is necessary.

In accordance with another aspect of the present invention, in order to provide readily accessible means for cleaning the curved side of the cardholder which engages the paper sheet, the cardholder together with its integral ribbon guide means and optional end of ribbon sensing means, is mounted so that it may be pivoted away from the platen for cleaning purposes and then pivoted back into operational position. Since the integral ribbon guide means and integral end of ribbon sensing means will be pivoted along with the cardholder, no independent adjustments of these units are necessary and the cleaning operation may be expeditiously carried out.

BRIEF DESCRIPTION OF THE DRAWINGS

Referring now to the drawings, wherein a preferred embodiment of this invention is illustrated, and wherein like reference numerals are used throughout to designate like parts.

DESCRIPTION OF PREFERRED EMBODIMENT

Figure 1:
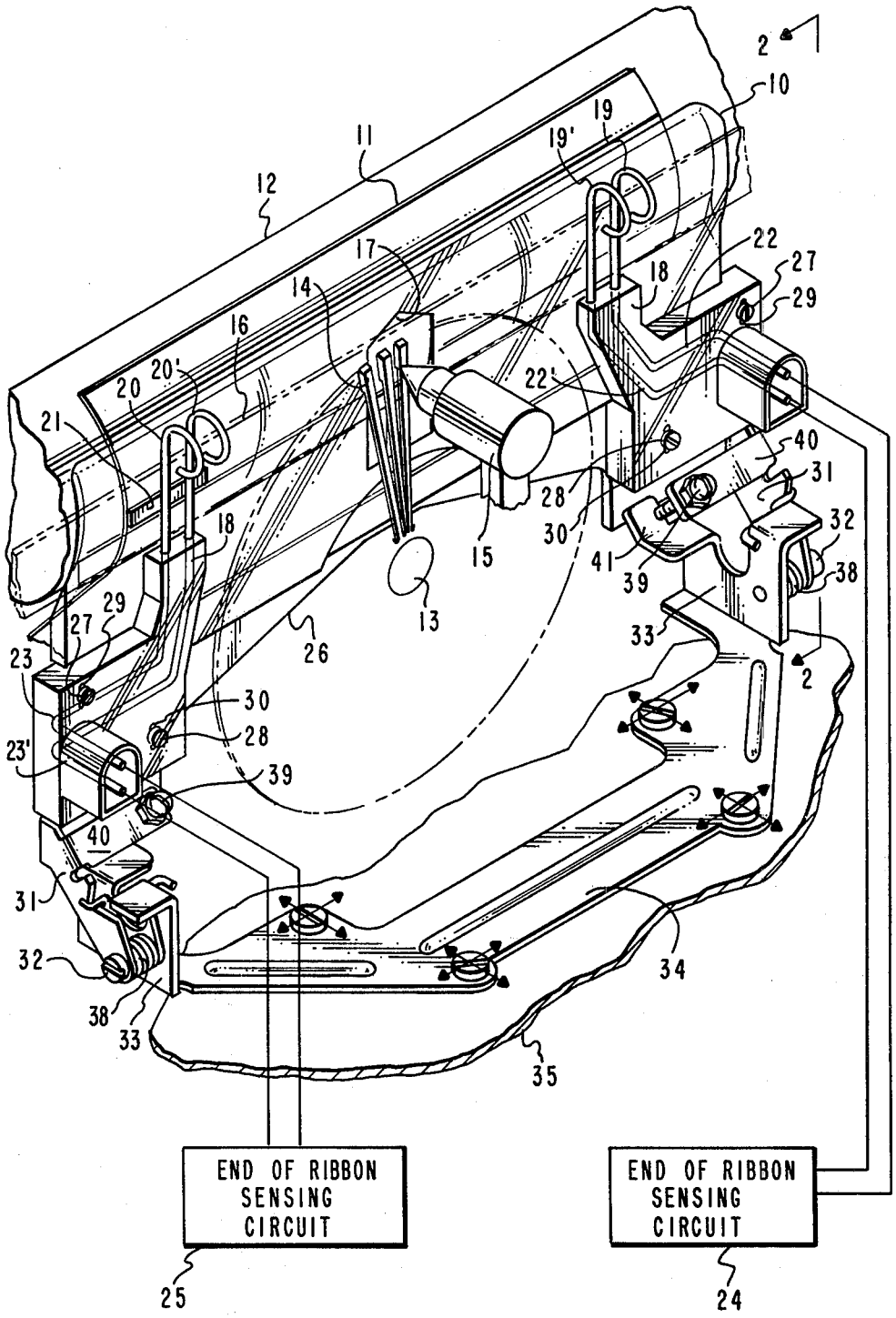
FIG. 1 shows a partial fragmentary perspective view of the cardholder, ribbon guide and end of ribbon sensing apparatus of the present invention.

With reference to FIG. 1, that portion of the printer apparatus necessary to illustrate the present invention is also shown. Cardholder 10 acts to retain paper sheet 11 with respect to platen 12. The apparatus further includes a conventional print wheel or daisy wheel 13 shown fragmentarily in phantom lines. This daisy wheel has a plurality of petals 14 containing the selected characters which are rotated into print positions in the conventional manner. Further, included are impact means 15, also shown in partial phantom for driving the petal and ribbon 16 through opening 17 in the cardholder 10 to effect printing. In the conventional manner, the print wheel together with the cardholder is moved laterally across the paper. They are supported on a carriage (not shown) driven by the conventional printer escapement mechanism (also not shown). During a printing step, opening 17 and cardholder 10 will be at a print position at some lateral point on sheet 11.

Figure 2:
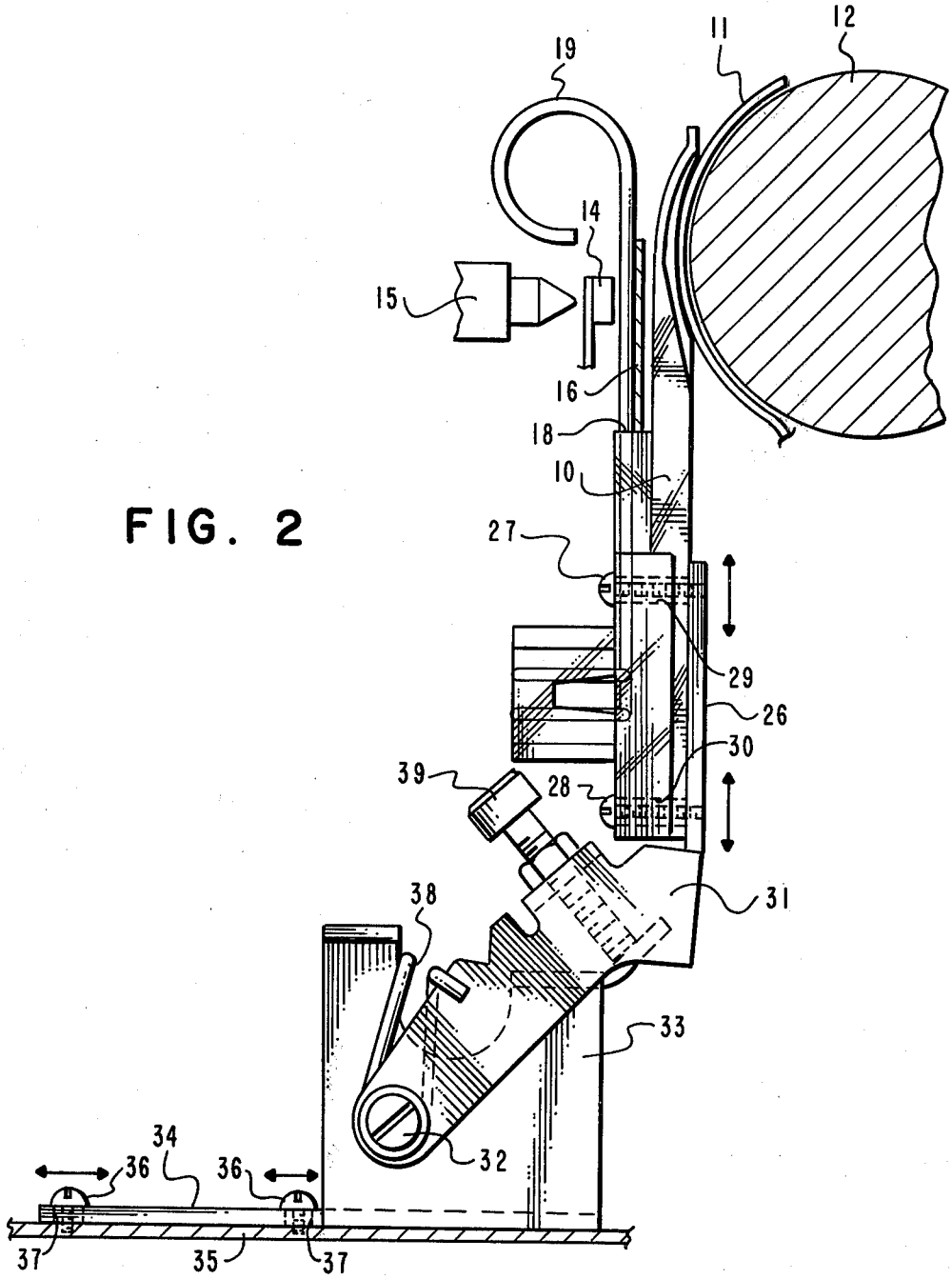
FIG. 2 is a partial right side of the apparatus of FIG. 1.

In order to describe the cardholder of the present invention in greater detail, reference should be made to the cross section in FIG. 2 in combination with FIG. 1. The cardholder includes integral ribbon guide means provided by a pair of cardholder ledges 18 which define the lowermost ribbon movement as it is moved along its path and two pairs of prongs 19 and 19' and 20 and 20' extending from ledges 18 to laterally contain the ribbon within its path. Although it cannot be discerned from the drawings, prongs 19 and 20 are respectively positioned slightly forward of prongs 19' and 20' so that the ribbon is slightly angled away from the cardholder 10 as it enters and leaves the guide means. The two pairs of prong, further, form part of the end of ribbon sensing apparatus. The prongs are electrically conductive and are respectively connected through corresponding pairs of inductive lead lines 22 and 22' and 23 and 23' to respective end of ribbon sensing circuits 24 and 25. The end of ribbon sensing circuits may be any conventional circuits which detect a completion of circuit and output the appropriate signal. The end of the ribbon is sensed through the end of ribbon tab 21 which is shown in position with respect to sensing prongs 20 and 20'. Since these prongs are spaced from each other, the electrical circuit is normally incomplete during printer operations. At the end of the ribbon, when conductive tab 21 crosses prongs 20 and 20' as shown, the circuit is completed and the end of ribbon sensing circuit outputs the appropriate signal. The two sets of prongs 19 and 19' and 20 and 20' and their associated end of ribbon sensing circuits 24 and 25 will respectively sense the end of ribbon conductive tabs positioned at either end of the ribbon depending on the direction of movement of the ribbon.

Considering now how cardholder 10 may be adjusted with respect to platen 12 and sheet 11, the cardholder is mounted on back plate 26 through a pair of bolts 27 and 28 which pass through a corresponding pair of longitudinal slots 29 and 30 and are tapped into back plate 26. Since slots 29 and 30 are longitudinal in the up and down direction, the cardholder may be moved up and down for the length of these slots to longitudinally adjust the cardholder prior to tightening bolts 27 and 28 to thus fix the cardholder in the longitudinal direction on back plate 26. The back plates 26 extending the length of the cardholder has a pair of arms 31 which are pivotably mounted about pivot 32 respectively supported in a pair of stanchions 33 extending from base plate 34. Base plate 34 is mounted on carriage frame 35 by four bolts 36 which pass through oversized holes 37 into the frame 35. Since these slots are oversized, the base plate 34 and thus the supported cardholder may be moved in all translational directions as shown by the arrows to adjust the distance of the cardholder to the platen as well as moving the cardholder to the right and to the left. Since the ribbon guide means and ribbon sensing means provided by prongs 19, 19', 20 and 20' are integral with the cardholder 10, they will, of course, be moved along with the cardholder, and no independent adjustment of either the ribbon guide means or end of ribbon sensing means will be required.

In addition, the present apparatus provides for rotational adjustment of the cardholder 10 with respect to the sheet 11 and platen 12. Spring members 38 (FIG. 2) act to urge back plate arms 31 in a clockwise direction about pivot 32 thus urging cardholder towards sheet 12 and platen 11. Adjustment bolts 39 connecting tabs 40 extending from arms 31 to corresponding tabs 41 extending from stanchions 33 may then be turned to offset the spring force of spring 38 and rotate the cardholder 10 in a counterclockwise direction to adjust the distance of the cardholder with respect to sheet 11 and platen 12. Again, in making such a rotational adjustment, the end of ribbon sensing means as well as the ribbon guide means which are integral with the cardholder will be correspondingly adjusted in the rotational direction.

For cleaning purposes, cardholder 10 as well as the sensing prongs and the ribbon guide means may be pivoted in a counterclockwise direction away from sheet 11 and platen 12 by applying and maintaining sufficient manual force to overcome the tension of springs 38. Upon completion of the cleaning, cardholder 10 is released back into its operational based position with respect to the sheet 11 and the platen 12. The position of the ribbon guide means and end of ribbon sensing means which are an integral with the cardholder will remain fixed with respect to the cardholder during this movement.

While the invention has been particularly shown and described with reference to a particular embodiment, it will be understood by those skilled in the art that various changes in form and detail may be made without departing from the spirit and scope of the invention.

What is claimed is:

1. In an impact printer having a curved platen and a cardholder with an inner surface having a curvature corresponding to the curvature of said platen mounted adjacent to but spaced from said platen so that a sheet of a printing medium may be moved between said cardholder and platen, said cardholder having an opening therein through which said sheet may be printed upon by impact means, the improvement wherein said cardholder comprises integral ribbon guide means for guiding a printer ribbon in a path spaced along the outer surface of said cardholder across said opening whereby said impact means may selectively drive said ribbon through said opening to print upon said sheet, said ribbon guide means including two pairs of electrically conductive members respectively fixed to said cardholder on opposite sides of said opening, and circuit means connected to said pairs of conductive members for detecting when a conductive element in an end of said ribbon contacts both conductive members of one of said pairs to provide a conductive path between said members, whereby conductive elements at opposite ends of a printer ribbon may be sensed dependent on the direction of movement of said ribbon.

2. The printer of claim 1 further including means for adjusting the position of said cardholder with respect to said platen whereby the positions of said integral ribbon guide means and ribbon sensing means are correspondingly adjusted.

3. The printer of claim 1 wherein said cardholder is mounted pivotably so that it may be pivoted away from the platen for cleaning purposes.

* * * * *